United States Patent [19]

Nikkel

[11] 4,005,529

[45] Feb. 1, 1977

[54] CORRUGATING STATION ASSEMBLY GUIDE

[75] Inventor: Willem A. Nikkel, Covington, Va.

[73] Assignee: Westvaco Corporation, New York, N.Y.

[22] Filed: Mar. 25, 1976

[21] Appl. No.: 670,535

[52] U.S. Cl. ..... 33/181 R; 81/3 R; 156/205; 156/473

[51] Int. Cl.[2] ..... B31F 1/22

[58] Field of Search ..... 156/205–208, 156/210, 470–473, 578; 118/216, 221, 245, 246, 252, 256, 258; 425/369; 81/1 R, 3 R; 33/174 R, 181

[56] References Cited

UNITED STATES PATENTS

| | | | |
|---|---|---|---|
| 1,587,638 | 6/1926 | Feybusch et al. | 118/245 |
| 1,642,782 | 9/1927 | Langston | 156/473 X |
| 1,804,365 | 5/1931 | Price | 118/245 |

*Primary Examiner*—David A. Simmons
*Attorney, Agent, or Firm*—W. Allen Marcontell; Richard L. Schmalz

[57] ABSTRACT

In a corrugated board machine, the stripper finger relief grooves of an adhesive applicator roll may be quickly meshed with corresponding fingers when the applicator roll is to be returned to operating position by use of a manually manipulated alignment guide which confines the fingers laterally to the correct spatial alignment with corresponding grooves.

5 Claims, 2 Drawing Figures

CORRUGATING STATION ASSEMBLY GUIDE

BACKGROUND OF THE INVENTION

1. Field of the Invention

The present invention relates to the art of fabricating corrugated board from sheet or web material. More specifically, the present invention relates to a method and apparatus for facilitating the expedient re-assembly of a glue applicator roll into operative position with a corrugating roll.

2. Brief Description of the Prior Art

Corrugated board such as fabricated from paper web is manufactured by forming the length of a medium web into a continuum of transverse undulations, each undulation period being known as a flute. To the crest of each flute, on one surface side of the corrugated medium, is secured, as by adhesive bonding, a flat, liner web.

Subsequently, if desired, a second liner web may be adhered to flute crests of the opposite surface side of the corrugated medium to form what is known as "Double-faced" board.

This lamination process may be repeated as often as desired by alternating a corrugating medium with a liner web to achieve greater strength and thickness, the flute crests of each corrugated medium being adhered to the previously applied liner.

The corrugated medium begins as a flat, fourdrinier laid paper web which is drawn into the nip between two corrugating rolls. Such corrugating rolls are, generally, axially rotating cylinders having a corrugated surface pattern, the corrugation flutes extending parallel with the roll axes.

Two such corrugating rolls are meshed gear-like to form a cooperative, undulating nip into which the medium web is pressure formed to the desired shape.

Upon emerging from the corrugating nip, the "memory" characteristic of the corrugated medium exerts a restoration force to the original, flat configuration that resultantly tends to warp the web. To resist this tendency, gudes or stripper fingers are provided to hold the corrugated web tightly to the surface of one corrugating roll upon emerging from the corrugating nip. These fingers extend arcuately around the transfer corrugating roll from the corrugation forming nip to a cooperative nip with a flat surface pressure roll which presses the first liner web into contact with the medium flute crests. Normally, these fingers are spaced approximately two to four inches (50–100 mm) apart thereby requiring 23 to 46 fingers on an 87 inch (2200 mm) machine (web width).

Arcuately intermediate of the corrugation forming nip and the liner pressing nip, adhesive must be applied to the flute crests for the purpose of bonding the medium and liner together.

The usual prior art technique of applying adhesive to the flute crests is by means of a glue station comprising a glue roll rotating adjacent a doctor roll. A chordal portion of the glue roll is immersed in a pool of liquid adhesive to pick up a surface film of the adhesive which is trimmed to a desired thickness by the doctor roll. A portion of the remaining adhesive film on the glue roll is transferred by rotational wiping to the flute crests.

Because the adhesive must be applied to the medium flute crests along the arc between the corrugation forming nip and the liner nip, the glue roll is grooved to accommodate the web depth of the fingers. So as to assure uniform adhesive application to the flute crests between the fingers, these glue roll grooves are as narrow as tolerable. Similarly, the web thickness of the fingers is as narrow as tolerable.

In the production running of a corrugating machine as heretofore described, it is frequently necessary to withdraw the glue station, as a composite assembly from the corrugator, to gain physical access to the finger arc of the corrugating roll. Finger adjustment or machine clearing and cleaning following a jam dictates such necessity.

Due to the close tolerance between the finger and the glue roll grooves as compounded by the multiplicity of such finger-groove combinations, it is an extremely tedious and time consuming task to re-position the glue roll following disengagement.

It is therefore an object of the present invention to teach a method and apparatus whereby the finger grooves of an adhesive application roll may be meshed with all the stripper fingers of a corrugating transfer roll simultaneous with the application roll approach to the corrugating roll.

SUMMARY OF THE INVENTION

This and other objects of the invention will be seen from the following description which comprises an alignment tool having a finger plate that is slotted along one edge to match the glue roll groove spacing. Each slot may be flared or tapered to permit a greater capture area so that slightly misaligned fingers will be positively guided to the correct relative spacing as the plate edge is pushed into engagement with the corrugating transfer roll.

In alignment with the finger slots on the tool plate are ribs or dowels, as desired, projecting normally from the plate plane. Such slots or ribs are positioned in planar alignment with a planar extension of the slot lengths. These ribs are meant to be meshed with the glue roll grooves.

In use, therefore, an operator may place the present alignment tool ribs in the glue roll grooves with the tool weight supported tangentially on the glue roll surface. The slotted plate is then held in a generally normal orientation relative to the fingers and advanced to a position where the fingers are laterally confined within the slot lengths. As the glue station unit is thereafter moved toward the operating position, all fingers will consequently be retained in perfect alignment with respective grooves for simultaneous meshing as the tool ribs slide within the glue roll grooves.

BRIEF DESCRIPTION OF THE DRAWING

Relative to the drawing wherein like reference characters designate like or similar elements throughout the two figures of the drawing.

BRIEF DESCRIPTION OF THE PREFERRED EMBODIMENT

Figure 1:
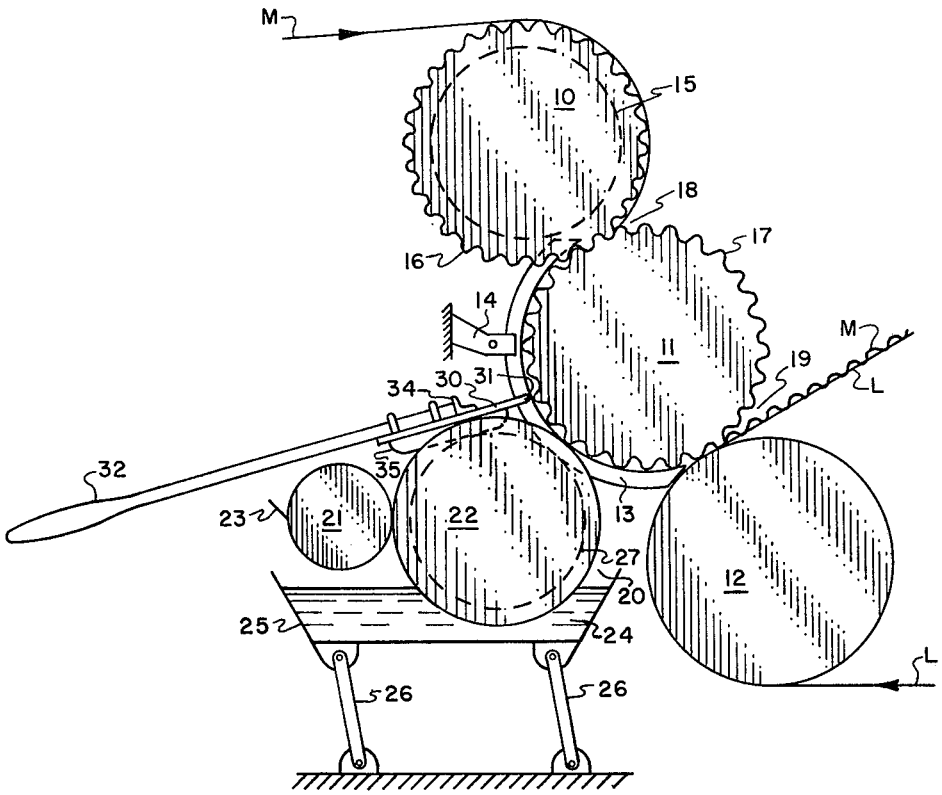
FIG. 1 is a schematic elevation of a conventional corrugating station illustrating the present invention apparatus in use position.

For orientation, FIG. 1 shows a corrugating station comprising two corrugating rolls 10 and 11, the roll 11 being the medium web transfer roll of the pair. Both corrugating rolls have longitudinally fluted surfaces comprising matched undulations 16 and 17 which mesh at the corrugating nip 18. A continuous web of medium M is drawn over the roll 10 and into the nip 18 to be pressed into a corrugated continuum between meshed corrugating surfaces 16 and 17.

Upon emerging from the nip 18, the medium M seeks return to the original, flat condition but is prevented from doing so by stripper fingers 13. These fingers are positioned to completely encompass the circular arc of the corrugated medium crests between the corrugating nip 18 and the press nip 19 where pressure roll 12 presses a liner web L into adhesive contact with the corrugation crests.

Since stripper fingers 13 are laterally separated, each from the other, across the machine width (roll length) by approximately 2 to 4 inches and spaced radially from the crests of corrugations 17 by approximately the thickness of the medium M, usually 0.009 inch, little freedomm is left to the medium M to comply with the restoration stresses exerted internally therein.

Each finger 13 is rigidly held in the described position by a frame mounted finger clamp 14.

Within the arc of transfer roll 11 between nips 18 and 19, adhesive must be applied to the corrugation crests of medium M. For this purpose, a glue station 20 is provided which comprises a glue roll 22, a doctor roll 21 and a doctor blade 23 positioned in edge wiping proximity with the surface of the doctor roll 21. An arcuate portion of glue roll 22 is immersed in a pond 24 of liquid adhesive contained by a pan 25.

So as to permit maintenance access to the transfer arc of corrugating roll 11, the stripper fingers 13 and the pressure nip 19, the entire glue station 20 is movable as a unit on glides or links 26.

Due to the obvious structural interference between the fingers 13 and the surface of glue roll 22, relief grooves 27 are cut around the circumference of the glue roll of such depth and width as to permit a running engagement of the glue roll surface with the corrugated crests of the medium M.

It is the necessity to re-engage the fingers 13 with the grooves 27 each time the glue station is withdrawn from the corrugating roll 11 that gives rise to the present invention which comprises a structural plate member 30 having a leading edge 31 and manual control handles 32. Into the leading edge 31 are cut a plurality of slots 33 of sliding fit width relative to the web of fingers 13 and preferably not quite as deep. These slots 33 are laterally spaced along the leading edge 31 by a distance equal to the lateral spacing of grooves 27 for the intended corrugating machine. If desired, the mouth of slots 33 may be belled or flared for a short distance of the depth.

On the top side of the plate 30, to which it is convenient to attach the handles 32, is provided a structural rigidifying member 34.

Figure 2:
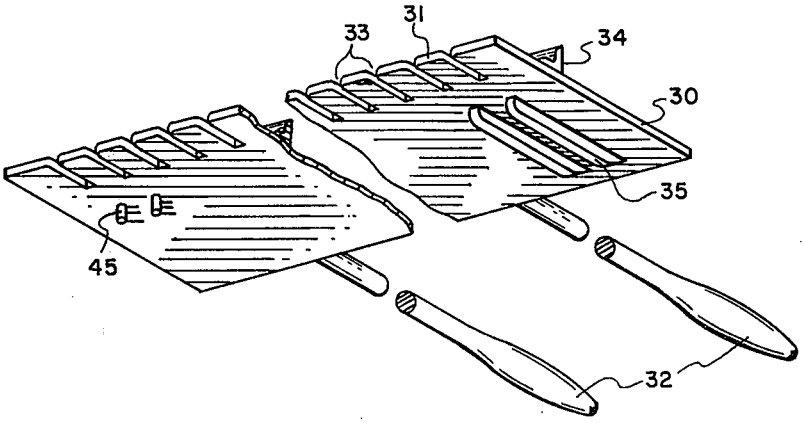
FIG. 2 is perspective view of the present invention apparatus.

On the bottom side of the plate 30 is provided one or more projections in alignment with planar extensions of the depth of slots 33. Such projections may take the form of ribs 35 or pins 45 as seen from FIG. 2. The particular shape these projections may take is irrelevant to the necessity for a sliding fit width relative to corresponding glue roll grooves 27. It is also unnecessary for there to be a projection 35 or 45 respective to each groove 27 so long as those projections provided are in alignment with the corresponding slot 33 and groove 27 plane.

Conversely, it is strongly recommended that a slot 33 be provided for each finger 13 on the intended machine since each such finger may deflect from a correct groove 27 alignment position independently of the other fingers.

Use of the present invention is by placing the bottom surface of plate 30 tangentially against the surface of a disengaged applicator roll 22 with the projections 35 penetrating corresponding grooves 27. Using handles 32, the entire alignment tool is moved toward the roll 11 and the fingers 13 manipulated until all are confined laterally within respective slots 33. From this position, all fingers 13 and corresponding grooves 27 are in positive, controlled alignment, each with the other. As the glue station 20 is thereafter advanced to operating position, the projections 35 will slide within the grooves 27 while maintaining the necessary alignment between the fingers 13 and grooves 27. Consequently, the necessity for carefully manipulating each finger 13 simultaneous with advancement of the entire glue station 20 mass is averted.

Having fully described my invention, I claim:

1. A method of meshing glue application roll relief grooves with corresponding corrugating roll stripper fingers comprising the steps of:

A. Providing a structural member having a leading edge and at least one planar surface parallel with said edge;

B. Providing slots in said leading edge of sliding fit width relative to a corresponding stripper finger web width, the depth of said slots being normal to said leading edge;

C. Providing structural projections from said planar surface of sliding fit width relative to a corresponding relief groove width, said projections being in parallel alignment with the depth of said slots;

D. Positioning said structural member tangentially against said applicator roll with said stripper fingers meshed with said slots and said projections meshed with said grooves; and E. Moving said applicator roll into operative proximity with said corrugating roll.

2. An alignment tool for engaging circumferential relief grooves in an adhesive application roll with a plurality of stripper fingers having a web depth and thickness secured adjacent a corrugating transfer roll of a corrugated board fabrication machine, said tool comprising:

A. Plate means having a substantially planar surface and linear leading edge, said plate means having a width normal to said leading edge approximately equal to a radial distance from a corrugation crest surface of said transfer roll to the mmost proximate tangent with the surface of said applicator roll at an operatively disengaged position, said leading edge having a length greater than the distance between stripper fingers disposed at opposite distal ends of said transfer roll;

B. A plurality of slots in said plate means open at said leading edge and extending normally thereto to a length approximately equal to said stripper finger web depth, said slots having a sliding fit width relative to corresponding stripper finger web width, the number and lateral spacing of said slots corresponding to the number and lateral spacing of said relief grooves;

C. At least one projection extending normally to said planar surface in substantial alignment with a planar extension of the depth of a corresponding slot, said projections having a sliding fit length and width relative to a corresponding application roll relief groove.

3. A tool as described by claim 2 wherein the leading edge opening width of said slots is flared.

4. A tool as described by claim 2 wherein said projections are elongated rib means.

5. A tool as described by claim 2 wherein said projections are rod means.

* * * * *